United States Patent [19]

Hanley et al.

[11] 4,220,504

[45] Sep. 2, 1980

[54] SELECTIVE ELECTROPLATING

[75] Inventors: William H. Hanley, Los Angeles; Clarence O. Schrader, Santa Ana, both of Calif.

[73] Assignee: Burton Silverplating Company, Los Angeles, Calif.

[21] Appl. No.: 31,909

[22] Filed: Apr. 16, 1979

[51] Int. Cl.[2] ..... C25D 5/06; C25D 17/14; C25D 17/28

[52] U.S. Cl. ..... 204/15; 204/224 R

[58] Field of Search ..... 204/15, 224 R, 212

[56] References Cited

U.S. PATENT DOCUMENTS

| | | | |
|---|---|---|---|
| 936,472 | 10/1909 | Pfanhauser | 204/206 |
| 3,073,764 | 1/1963 | Sullivan | 204/224 R |
| 3,102,090 | 8/1963 | Bassi | 204/224 R |
| 3,293,162 | 12/1966 | Sullivan | 204/224 R |
| 3,661,752 | 5/1972 | Capper et al. | 204/206 |
| 3,691,026 | 9/1972 | Durrwachter et al. | 204/15 |
| 3,751,343 | 8/1973 | Macula et al. | 204/15 |
| 3,904,489 | 9/1975 | Johnson | 204/15 |
| 3,951,772 | 4/1976 | Bick et al. | 204/198 |
| 3,966,581 | 6/1976 | Holte | 204/202 |
| 4,064,019 | 12/1977 | Eidschun | 204/15 |
| 4,078,982 | 3/1978 | Eidschun | 204/224 R |
| 4,119,499 | 10/1978 | Eidschun | 204/15 |

FOREIGN PATENT DOCUMENTS

| | | | |
|---|---|---|---|
| 331930 | 10/1903 | France | 204/224 R |

OTHER PUBLICATIONS

Materials and Methods, vol. 40, No. 6, 1954, *Brush Plating Now Practical*, M. Rubinstein.

Technical Proceedings of the 43rd Annual Convention of the American Electroplater's Society, pp. 246–255, 1956.

Gold Plating Technology by Frank H. Reid et al., 1974, pp. 181–201.

*Primary Examiner*—T. M. Tufariello

*Attorney, Agent, or Firm*—Vincent G. Gioia; William J. O'Rourke, Jr,

[57] ABSTRACT

A method for electroplating a selective area of a part is disclosed comprising the steps of rotating a disc having an absorbent upper surface, maintaining electrolytic solution on the absorbent upper surface of the disc. While such disc is charged anodically and the part is charged cathodically, the part is passed across a chord of the circle within which the disc rotates with the selective area of the part in contact with the electrolytic solution on the rotating disc.

22 Claims, 6 Drawing Figures

SELECTIVE ELECTROPLATING

BRIEF SUMMARY OF THE INVENTION

Various mechanical arrangements and devices used for electroplating of a variety of objects have been disclosed over the past century, as evidenced by Pfanhauser U.S. Pat. No. 936,472. More recent developments in this area have concentrated upon plating of selective areas of objects. it is readily understandable that the concentration of the plating onto a small area of a part results in a reduction in the amount of plating material. In the area of precious and semi-precious metal plating, including gold, silver, platinum, rhodium and the like, a reduction in plating materials significantly affects total electroplating costs. For example, by selectively plating gold only on a portion of the outside convex surface of an electrical contact by a selective brush plating process, the savings in gold alone can be reduced at least by 50% and perhaps as much as 85% as compared to the prior art dip coating process.

Selective plating has been recognized for its material savings for years. For example, in the Technical Proceedings of the 43rd Annual Convention of the American Electroplaters' Society (1956), author Marv Rubinstein discusses the then recent developments in selective, localized plating. One of many designs mentioned therein is that of an anodic wheel wrapped with an absorbent sponge. The wheel rotates through a trough of electroplating solution and the sponge retains a portion of the solution. The material to be plated is continuously passed over the wrapped roller, with the result that only the side of the material that contacts the roller is electroplated with little or no overlap. Applications for such selective localized plating include silvering of bus bars, black nickel plating for high temperature purposes, and gold and rhodium plating of electrical contacts.

In *Gold Plating Technology,* Reid and Goldie (1974) Chapter 16, also written by Marv Rubinstein, is devoted to "High Speed Selective (Brush) Plating." This chapter includes a description of the well known stylus, a rotating anode wrapped with an absorbent material. The rotating stylus is dipped in electroplating solution then brought into contact with the cathodic charged surface to be plated thus completing the circuit. Mr. Rubinstein also recognizes the value of selective plating in the electrical field. As an example, worn areas on printed circuit edge connector contacts and on electrical contacts have been plated by the described selective plating techniques.

Bick et al. U.S. Pat. No. 3,951,772 teaches a selective plating apparatus in which an anodic applicator, such as an absorbent conveyor belt is passed through an electroplating solution. The selected portions of the cathodic charged parts to be plated are brought into contact with the applicator to complete the circuit and selectively electroplate the small portion of the part.

In the above teachings, the part to be plated is brought into contact with the electroplating solution on the outer peripheral surface of the rotating, cathodic charged tool. The use of rotating tools, such as stylus, wheels, rollers, drums, or the like, having absorbent outer peripheral surfaces is well known in the field of electroplating.

In the area of electroplating, such as the plating of gold onto a small area of an electrical contact, it is important to obtain multiple scrubbing directions across the area to be plated. Such multiple scrubbing directions during electroplating has the effect of continuously cleaning the coating surface of unwanted deposits and adverse contaminants or accumulations, such as codeposited hydrogen, as the gold coating is being electrodeposited. Such action results in a more uniform and higher quality coating on the part.

Also, it is beneficial to control the amount of electroplating solution that is present on the surface with which the part to be plated is brought into contact. In the roller mechanism disclosed in Rubinstein's 1956 presentation, and in the conveyor mechanism of Bick et al., the absorbent surface on the moving part is passed through the solution. Various operating conditions, including the depth of the moving part in the solution, the wear of the absorbent surface on the moving part, the speed of the electroplating, etc. affects the uniformity of the electroplating solution deposited upon the selective coating mechanism, and thus affects the electroplating process itself. Therefore, it is desirable to employ a process which insures substantial uniformity in the amount of electroplating solution to which the parts to be plated are subjected.

Further, when using an absorbent surface in an electroplating apparatus, eventually the surface shall require replacement. It is desirable to be able to replace the absorbent surface quickly and easily so as to minimize interference and interruiption of the continuous electroplating operation.

Accordingly, a method of selective electroplating of parts is desired which provides improvements in the operation and in the quality of electroplating over that known in the art.

The present invention may be summarized as providing a new and improved method and apparatus for electroplating a selective area of a part comprising the steps of rotating a disc, with the disc having an absorbent upper surface, and continuously maintaining an electroplating solution on the absorbent upper surface of the rotating disc. While the disc is charged anodically and the part is charged cathodically, the part is passed across a chord of the circle within which the disc is rotated with the selective area of the part in contact with the electrolytic solution on the disc.

Among the advantages of the present invention is the provision of a method and an apparatus for electroplating a selective area of a part by continuously brushing the area to be plated in a variety of directions, and at a variety of speeds, during electroplating to produce a more uniform and higher quality coating on the part.

Another advantage of the present invention is to provide an electroplating method and apparatus in which the amount of electroplating solution available for contact with the area of the part to be plated is maintained uniformly, evenly and continuously on an absorbent anodic surface to insure uniformity in the plating operation.

These and other advantages and objectives of the invention will be more thoroughly understood and appreciated with reference to the following description and the accompanying drawings.

DETAILED DESCRIPTION

Figure 1:
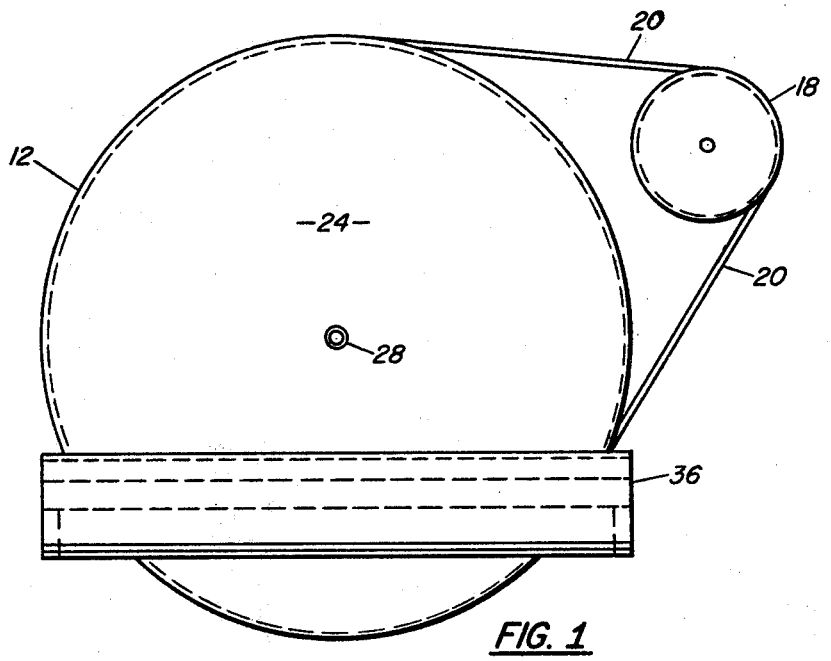
FIG. 1 is a top elevation view of a disc plating apparatus fo the present invention.
Figure 2:
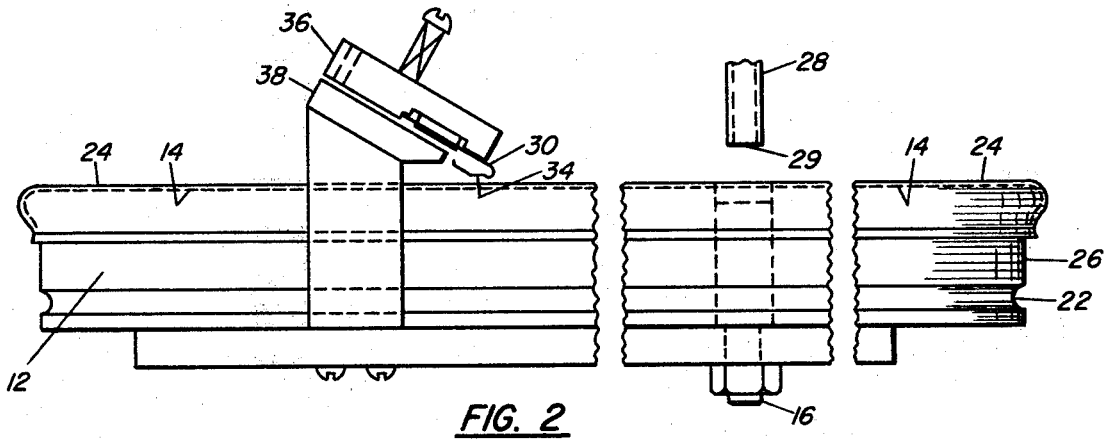
FIG. 2 is a side elevation view of the disc plating apparatus shown in FIG. 1.

Referring particularly to the drawings, FIGS. 1 and 2 illustrate a preferred disc plating apparatus of the present invention. The apparatus includes a rotatable disc 12 having a substantially planar upper surface 14. As shown in FIG. 1, the disc is positioned for rotation substantially in the horizontal plane. It will be understood by those skilled in the art that the angular disposition of the disc may vary despite the fact that in the illustrated embodiment the disc is substantially level with the horizontal plane for reasons that will be explained below.

The rotatable disc 12 which is the anode in the apparatus of the present invention, may be constructed of a variety of metals, or of carbon or more preferably of graphite. The anode should contain a minimum amount of impurities that could contaminate the electrolytic solution. The disc shaped anode 12 is mounted to an axle 16. Typically, the anodic disc 12 may be electrically connected at the axle 16.

Rotation of the disc shaped anode 12 may be accomplished by a variety of methods. In a preferred embodiment, a motorized drive pulley 18 is provided adjacent the disc 12. A belt, such as a typical "O-ring" belt 20 may be disposed tightly around the drive pulley 18 and the disc 12. In a preferred arrangement, a groove 22, semicircular in cross section, is provided about the periphery of the disc 12 in which the belt 20 seats. It will be understood by those skilled in the art that a variety of belts, drive mechanisms and the like may be employed to rotate the disc 12 of the present invention.

The anodic disc 12 should be provided with an absorbent upper surface. Preferably, an absorbent cover 24 may be provided over the entire upper surface 14, or face, of the disc 12. The cover may be constructed of felt, velvet, polyproplene wool or any absorbent material. Typically, the cover extends across the entire face 14 of the disc 12, extends downwardly, with respect to the upper surface 14, about the periphery of the disc and is secured thereto to prevent any substantial movement of the cover during operation of the disc plating apparatus. The cover 24 may be easily installed over the disc 12 and quickly attached about the outer peripheral wall 26 of the disc 12 by a continuous elastic band, or belt, by a tie down or button down mechanism, by a vice type arrangement within the disc or by a variety of known devices. The absorbent cover 24 should also be arranged to lie substantially flush with the substantially planar top surface 14 of the disc 12.

A bath of electrolytic solution (not shown) should be provided for the operation of the apparatus of the present invention. For convenience, the bath of electrolytic solution should be provided near the rotatable disc 12. In the operation of the disc plating apparatus of the present invention as illustrated in FIGS. 1 and 2, the electrolytic solution is continuously deposited onto the absorbent surface 24 of the disc 12. In a preferred embodiment, the electrolytic solution is delivered by a pumping mechanism, a suction device, or the like, to a spout 28 having a discharge port 29 disposed above the disc 12. The electrolytic solution may be pumped from below the disc, or the solution could be delivered to a port located between the surface 14 of the disc 12 and the absorbent surface 24 thereon. It will also be appreciated that a plurality of spouts may be employed in this particular embodiment. Regardless of the mechanism used to deliver the electrolytic solution to the disc shaped anode, the solution should be continuously and uniformly applied to the surface of the rotating disc 12.

As shown in FIG. 2, a discharge port 29 of the spout 28 is preferably located above the center point of the rotating disc. By such arrangement, the solution is deposited directly onto the middle of the disc 12 and by the centrifugal force established by rotation of the horizontally level disc, the solution flows substantially uniformly toward the periphery of the disc 12. It will be understood that a plurality of discharge ports evenly spaced near the center of the disc would accomplish the same, uniform flow results.

It will also be appreciated that in instances where an over abundance of electrolytic solution is experienced at the periphery of the disc 12, provisions should be made to collect the overflowing solution and deliver such solution to the electrolytic bath supply. To insure that the overflowing solution does not interfere with the operation of the disc plating apparatus, the periphery of the disc 12 near the upper surface 14 may be constructed of a larger diameter than the lower portions of the outer peripheral wall 26 to insure that the overflowing solution flows downwardly from the absorbent surface 24 of the disc into a collection tank, or the like, therebelow without interfering with the operation of the apparatus. Also, depending upon the speed of rotation of the disc 12, it may be necessary to install a deflector (not shown), or the like, about the periphery of the disc 12 to catch electrolytic solution that may be tangentially discharged from the disc during rotation thereof. Such deflector should catch the discharged solution and recycle it to the electrolytic bath supply.

In alternative embodiments, not illustrated in the drawings, the disc 12 may be angularly disposed. In one embodiment the disc 12 may be disposed substantially in the vertical position. With such arrangements the electrolytic soluton may be deposited along the upper portion of the surface 14 of the disc 12. The solution should be deposited at a location and at a rate that assures substantial uniformity across the absorbent surface 24, especially at the location of electroplating contact. In an embodiment where the disc 12 is angularly disposed, the lower portion of the rotating disc 12 may continuously pass through a reservoir of electrolytic solution. By rotating a portion of the disc 12 through such reservoir, a uniform quantity of electrolytic solution is maintained on the absorbent surface 24. Those skilled in the art appreciate that the rotating disc 12 may have to be treated with doctor rollers, squeeges, or the like to maintain a uniform quantity of electrolytic solution of the surface of the disc 12, at least at the location of electroplating contact.

The parts to be plated by the disc plating apparatus of the present invention may include various electrical components, such as electrical contacts. By way of examply only, this invention may also be applied to the electroplating of a continuous belt or ribbon, flat chain or cable, and jewelry. The substantially large face of the rotating disc of the present invention also lends itself to the electroplating of relatively large parts or large areas on parts.

Figure 3:
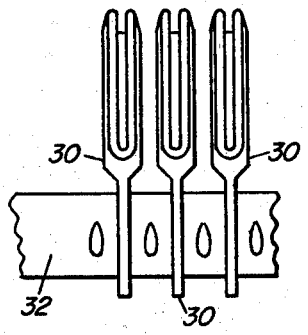
FIG. 3 is a top elevation view of typical parts that may be electroplated by the apparatus of the present invention.
Figure 4:
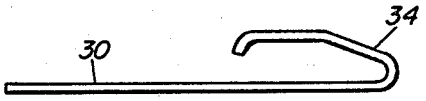
FIG. 4 is a side elevation view of a typical part shown in FIG. 3.

In a preferred embodiment, the disc plating apparatus of the present invention is used to apply a gold coating onto a small selective area of an electrical contact. Electrical contacts 30, such as those shown in FIGS. 3 and 4, are typically stamped from a metal, such as iron, copper, aluminum, nickel, titanium and their alloys. Typically, a number of electrical contacts 30 are centrally mounted on a metallic carrying belt 32. The parts to be electroplated should be cathodically charged during operation. By contacting any location along the metallic carrying belt 32, or along the parts 30 connected thereto, with a cathodic charge, the entire string of parts remains cathodically charged. Maintaining this cathodic charge may be accomplished by cathodically charging the guide plates 36 and 38 through which the string of parts are passed. The guide plates 36 and 38 are continuously urged against the string of parts passing therebetween, and are able to maintain the cathodic charge on the parts being electroplated. The parts to be electroplated may be cathodically charged by various other methods.

The metallic carrying belt 32, as illustrated in FIG. 3, is usually wound on a spool (not shown). In the start-up of an electroplating line, usually the first fifty to one hundred feet of parts are manually threaded through the various preliminary cleaning and treating stations and the electroplating stations to a motorized take-up reel, located at the downstream extremity of the electroplating line. Alternatively, the belt 32 of parts 30 may be threaded through a tractor, or similar device, located in the electroplating line. The take-up reel, or tractor mechanism, or both, is activated at a desired speed to pull the string of parts through the various stations in the line.

At certain stations in the electroplating line, the disposition of the part with respect to the various treating solutions and devices is important. At such locations guides, such as the pair of opposed, spring urged guide plates 36 and 38 shown in FIG. 2, may be used to insure proper disposition of the parts. The guide plates 36 and 38 shown in FIG. 2 are stationarily mounted such that the part 30 pulled therethrough contacts the absorbent cover 24 on the rotating disc only at the selective area which is to be plated in accordance with the present invention. Preferably, the guide plates 36 and 38 are linearly disposed across a chord of the circle within which the disc 12 rotates. The chord may be at any location across such circle including the diameter. It should be understood that the use of curvilinear guide plates would be comprehended by the present invention. Use of the term chord preferably refers to a straight line connecting the extremities of an arc of a circle, however, the term as used herein also refers to arcuate or curvilinear paths across the circle within which the disc rotates. The speed at which the parts are pulled through the guide plates 36 and 38 and the speed at which the disc 12 rotates should be empirically determined to establish contact therebetween for the time required to deposit the desired plating thickness onto the selective area of the part. Electroplating times may vary depending upon the type of electroplating solution employed, the current density, the metal concentration in the solution, and the like.

Figure 5:
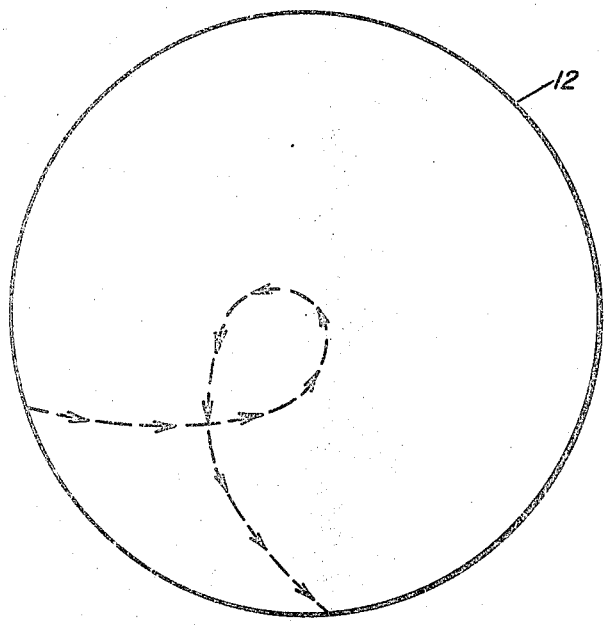
FIGS. 5 and 6 show various paths that the part to be plated would follow on a rotating disc when the part is passed across a chord of the circle within which the disc rotates.
Figure 6:
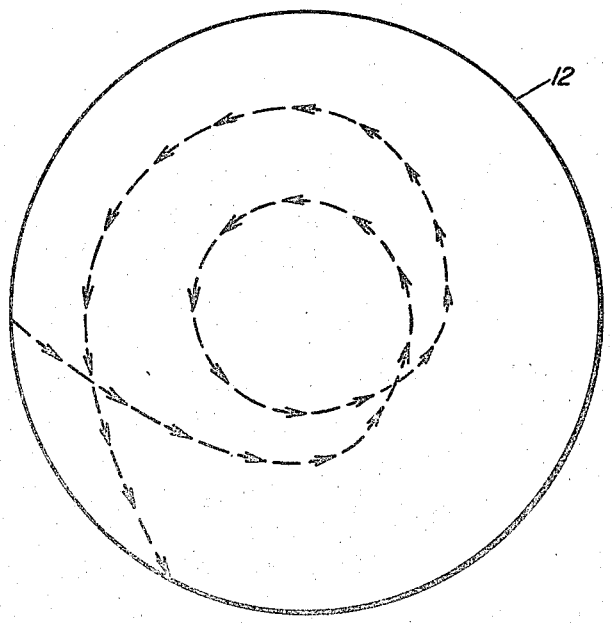

As mentioned above, the selective areas of the parts 30 to be plated are brought into contact with the electrolytic solution on the absorbent cover 24 of the rotating anode disc 12. The part 30, or string of parts, is continuously passed across the disc 12 along a chord of the circle within which the disc rotates. It will be understood by those skilled in the art that the locus of points defined on the rotating disc by the parts passing across such chord is generally spiral. Exemplary paths of a disc contact are illustrated in FIGS. 5 and 6. FIG. 5 shows the locus of points defined on the rotating disc by a part passing across the diameter of the disc 12, while FIG. 6 shows the locus of points defined on the rotating disc 12 by a part passing across a path such as that defined by the guide plates 36 and 38 positioned as shown in FIG. 2. It will be understood that these configurations are merely exemplary and would vary depending upon disc speed and part speed.

A primary benefit of the present invention is to expose the selective area, such as that indicated by reference numeral 34 best shown in FIG. 4, on the part which is to be electroplated to a variety of brushing motions, directions and speeds throughout the electroplating operation. Such variety in brush contact has the effect of continuously removing unwanted contaminants from the selective area. In electroplating operations wherein the brushing motion, direction and speed is substantially constant, undesirable contaminants have a tendency to accumulate. As shown in FIGS. 5 and 6, the direction of brushing motion between the selective area of a linearly moving part 30 being electroplated and a rotating absorbent surface 24 of the disc 12 constantly changes. Additionally, as the electroplating contact point approaches locations near to the center of the absorbent surface 24 of the rotating disc 12, the speed of the disc at such contact point decreases. Thus, the speed of the contacting surfaces, with respect to one another is constantly changing throughout the electroplating operation of the present invention.

In an alternative embodiment, a plurality of strings of parts may be simultaneously pulled across the same disc at a plurality of locations. In such embodiment, the plural strings would, preferably, be passed across the disc in near parallel relationship. It may be necessary to provide different coating thicknesses on the selective areas of the different strings of parts, and by such alternative arrangement the disc could be rotated at a substantially constant speed, while the respective take-up reels, or tractor devices, for the respective plural strings of parts could be varied to accomplish the desired electroplating time necessary to obtain the desired coating thickness.

In another embodiment, a plurality of discs may be employed to selectively plate different or common areas of parts as they are passed across the respective discs. For example, if both extremities of one part had selective areas to be plated, the parts could be passed through guides across one disc to plate the selective area at one end, and reoriented through appropriate guides over another disc to selectively plate the selective area at the opposite end. Also, various types of coatings or various coating thicknesses could be applied onto the same selective area of one part at various disc locations in the same electroplating line. And, by employing different mat thicknesses on different discs, the selective area that is electroplated can be varied in size.

What is believed to be the best mode of this invention has been described above. It will be apparent to those skilled in the art that numerous variations of the illustrated details may be made without departing from this invention.

What is claimed is:

1. A method of electroplating a selective area of a part comprising the steps of:

rotating a disc, said disc having an absorbent upper surface, continuously maintaining electrolytic solution on the absorbent upper surface of the disc, maintaining an anodic charge on the disc and the electrolytic solution thereon, maintaining a cathodic charge on the part to be electroplated, and passing the part to be electroplated across at least a portion of a chord of the circle within which the disc rotates, with the selective area of the part in contact with the electrolytic solution on the disc continuously brushing the selective area in a variety of directions and at a variety of speeds as the part passes across the disc.

2. A method as set forth in claim 1 wherein the electrolytic solution is maintained by depositing the solution onto the disc at a location near the center point of the disc.

3. A method as set forth in claim 1 wherein a string of substantially identical parts connected by a metallic band is continuously passed across a chord of the circle within which the disc rotates, with the selective area of each part in contact with the electrolytic solution on the disc as the parts pass across the disc.

4. A method as set forth in claim 1 wherein the part is electroplated with a metal selected from the group consisting of gold, silver, platinum, nickel, copper, rhodium, paladium, indium, tin, and aluminum.

5. A method as set forth in claim 1 wherein the part is an electrical component.

6. A method as set forth in claim 5 wherein the electrical component is an electrical contact.

7. A method as set forth in claim 6 wherein the electrical contact is provided with a selective area consisting of a generally curved portion.

8. A method as set forth in claim 7 wherein the curved portion is convex.

9. A method as set forth in claim 8 wherein the convex portion is at one end of the electrical contact.

10. The method as set forth in claim 1 further comprising the step of passing the cathodically charged part across a chord of a circle within which a second anodically charged disc rotates, with the selective area of the part in contact with an electrolytic solution on an absorbent surface of the second disc as the parts pass across the disc.

11. The method as set forth in claim 3 further comprising the step of passing a second string of identical, cathodically charged parts to be electroplated, said parts being connected by a metallic band, across a second chord of the circle within which the disc rotates, said chords not intersecting, with the selective area of each part in the second string of parts in contact with the electrolytic solution on the disc as said parts pass across the disc.

12. A method of electroplating gold onto selective areas of substantially identical parts uniformly mounted on a metallic band, comprising the steps of:

rotating a disc, having an absorbent upper surface, substantially in a horizontal plane, continuously depositing an electrolytic solution onto the absorbent upper surface of the disc, maintaining an anodic charge on the disc and the electrolytic solution thereon, and while maintaining a cathodic charge on the parts, continuously passing the string of parts to be electroplated across a chord of the circle within which the disc rotates, with the selective area of each part in contact with the electrolytic solution on the disc, continuously brushing the selective area in a variety of directions and at a variety of speeds as each part passes across the disc.

13. An apparatus for electroplating a selective area of a part comprising:

a rotatable disc having an absorbent upper surface, means for rotating said disc, means for continuously maintaining an electrolytic solution on the absorbent upper surface of the disc, means for maintaining an anodic charge on the disc and the electrolytic solution thereon, means for maintaining a cathodic charge on the part to be electroplated, and means for passing the part to be plated across a chord of the circle within which the disc rotates, with the selective area of the part in contact with the electrolytic solution on the disc.

14. An apparatus as set forth in claim 13 wherein the means for maintaining an electrolytic solution on the absorbent surface includes means for depositing the electrolytic solution through a spout having a discharge port located near the center of the disc.

15. An apparatus as set forth in claim 13 wherein the part passing means comprises a driving mechanism located downstream of the disc to which one end of a string of identical parts mounted on a metallic band is connected, and a pair of opposed guide plates stationarily mounted across the chord of the circle within which the disc rotates through which the string of parts passes such that the selective area of each part contacts the electrolytic solution on the disc as each part passes across the disc.

16. An apparatus as set forth in claim 15 wherein the driving mechanism is a take-up reel.

17. An apparatus as set forth in claim 15 wherein the driving mechanism is a tractor device.

18. An apparatus as set forth in claim 15 wherein the guide plates are cathodically charged and such charge is tranferred to the parts as said parts pass through said guide plates.

19. An apparatus as set forth in claim 13 further including means for passing the cathodically charged part across a chord of a circle within which a second anodically charged disc rotates, with the selective area of the part in contact with an electrolytic solution on an absorbent surface of the second disc.

20. An apparatus as set forth in claim 15 further including means for passing a second string of identical, cathodically charges parts to be electroplated, said parts mounted on a metallic band, across a second chord of the circle within which the disc rotates, said chords not intersecting, with the selective area of each part in the second string of parts in contact with the electrolytic solution on the disc as the parts pass across the disc.

21. An apparatus for electroplating gold onto selective areas of substantially identical parts uniformly mounted on a metallic band, comprising:

a rotatable, anodically charged disc having an absorbent upper surface, lying substantially in a horizontal plane, means for rotating said disc, means for continuously depositing an electrolytic solution onto the absorbent upper surface of the disc at a location near the center of the disc, a pair of opposed guide plates cathodically charged, and stationarily mounted across a chord of the circle within which the disc rotates, and means for continuously passing the string of parts through the guide plates with the selective area of each part in contact with the electrolytic solution on the disc as each part passes through the guide plates and across the disc.

22. An electrical contact having a selective surface area electroplated by providing a rotatable disc with an absorbent upper surface, rotating said disc, continuously depositing an electrolytic solution onto the absorbent upper surface of the disc, maintaining an anodic charge on the disc and the electrolytic solution thereon, and a cathodic charge on the part to be electroplated, and passing the electrical contact across a chord of the circle within which the disc rotates with the selective surface area of the electrical contact in contact with the electrolytic solution continuously brushing the selective surface area of the electrical contact in a variety of directions and at a variety of speeds as the part passes across the disc.

* * * * *